US007758135B2

(12) United States Patent
Lam et al.

(10) Patent No.: US 7,758,135 B2
(45) **Date of Patent: *Jul. 20, 2010**

(54) SLIDING GUIDE RAIL SYSTEM FOR A DRAWER

(75) Inventors: Harn Lian Lam, Perak (MY); Harn Yan Lam, Perak (MY)

(73) Assignee: Harn Marketing SDN. BHD., Ipoh, Perak (MY)

( * ) Notice: Subject to any disclaimer, the term of this patent is extended or adjusted under 35 U.S.C. 154(b) by 0 days.

This patent is subject to a terminal disclaimer.

(21) Appl. No.: 12/507,429

(22) Filed: Jul. 22, 2009

(65) Prior Publication Data

US 2009/0278432 A1 Nov. 12, 2009

Related U.S. Application Data

(63) Continuation of application No. 11/516,401, filed on Sep. 6, 2006.

(30) Foreign Application Priority Data

Oct. 11, 2005 (MY) ..... PI20054768

(51) Int. Cl.
*A47B 88/00* (2006.01)

(52) U.S. Cl. ..... 312/334.6; 312/334.45

(58) Field of Classification Search ..... 312/334.6, 312/334.11, 334.13–334.18, 334.45, 334.27, 312/334.31, 334.33, 334.38, 350; 284/18–20; 16/86 A See application file for complete search history.

(56) References Cited

U.S. PATENT DOCUMENTS 3,484,891 A * 12/1969 Borgen ..... 16/86 R 3,842,564 A 10/1974 Brown (Continued)

FOREIGN PATENT DOCUMENTS

AT 006774 U1 4/2004

(Continued)

*Primary Examiner*—Janet M Wilkens
(74) *Attorney, Agent, or Firm*—Volpe and Koenig, P.C.

(57) ABSTRACT

A sliding guide rail system for slidably opening and closing a drawer within an article of furniture or other equipment, the system comprises a mounting bracket (10) for fixing the system to the article of furniture, a fixed guide (20) mounted on the mounting bracket, an intermediate rail (30) and a pull-out guide (40). The fixed (20) and pull-out guides (40) each have a slidably movable housing, a first slidable housing (50) enabling the intermediate rail (30) to be slidable on the fixed guide (20) and a second slidable housing (50') enabling the pull-out guide (40) to be in turn slidable on the intermediate rail (30). Each of the fixed guide (20), intermediate rail (30) and pull-out guide (40) have stops (60) disposed thereon for limiting the sliding movement of the first (50) and second slidable housings (50'), wherein a resiliently deformable damping member (52, 52') is located in a respective chamber (51) provided at each longitudinal end of the first and second slidable housings. The damping member (52, 52') has a buffer portion that projects out of and beyond its chamber (51) for engaging with a stop (60) at the travel limit of the slidable housing (50, 50'), the chamber being oversized relative to the portion of the damping member disposed within the chamber whereby the chamber accommodates expansion of the damping member when it is deformed by impact with the stop.

12 Claims, 13 Drawing Sheets

U.S. PATENT DOCUMENTS

| | | | | |
|---|---|---|---|---|
| 3,969,786 | A * | 7/1976 | Peak | 16/86 A |
| 4,469,384 | A | 9/1984 | Fler et al. | |
| 6,015,199 | A | 1/2000 | Netzer et al. | |
| 6,220,683 | B1 | 4/2001 | Chu | |
| 6,382,751 | B1 | 5/2002 | Chiu | |
| 6,682,160 | B2 | 1/2004 | Kung | |
| 6,945,620 | B2 | 9/2005 | Lam et al. | |
| 6,979,066 | B2 | 12/2005 | Yang | |
| 7,320,508 | B2 | 1/2008 | Booker et al. | |
| 2003/0222556 | A1 | 12/2003 | Larsen, Jr. | |
| 2004/0222723 | A1 | 11/2004 | Fitz | |
| 2004/0227444 | A1 | 11/2004 | Booker et al. | |
| 2005/0231083 | A1 | 10/2005 | Garcie, Jr. | |
| 2006/0091770 | A1 | 5/2006 | Ritter et al. | |
| 2007/0057608 | A1 | 3/2007 | Chiu | |

FOREIGN PATENT DOCUMENTS

| | | | |
|---|---|---|---|
| AT | 006775 | U | 4/2004 |
| DE | 7234477 | U | 9/1972 |
| DE | 2906128 | | 8/1980 |
| DE | 3422657 | | 12/1985 |
| DE | 19911312 | | 10/1999 |
| DE | 20011580 | U | 1/2001 |
| EP | 0439774 | A1 | 8/1991 |
| EP | 0488471 | A2 | 11/1991 |
| EP | 0768050 | | 4/1997 |
| EP | 0868866 | | 10/1998 |
| MY | PI20033759 | | 2/2003 |
| WO | 199842232 | A2 | 10/1998 |
| WO | 2004000071 | A1 | 12/2003 |

* cited by examiner

SLIDING GUIDE RAIL SYSTEM FOR A DRAWER

CROSS REFERENCE TO RELATED APPLICATION

This application is a continuation of U.S. patent application Ser. No. 11/516,401, filed Sep. 6, 2006, which is incorporated by reference as if fully set forth.

FIELD OF THE INVENTION

This invention relates to a sliding guide rail system for use in the furniture industry, and more particularly in a drawer that is slidably opened and closed.

Drawer guide rails are components in common every day use such as for drawers in desks or cabinets, and for industrial use such as pull-out storage shelves at a warehouse, cash registers at a supermarket, automated teller machines at banking kiosks, electronic equipment at telephone switching stations and so on.

BACKGROUND

Guide rail systems are provided for drawers to be either partially or fully opened or closed and typically consist of a bracket for fixing the system to the article of furniture, a fixed rail mounted on the bracket, a pull-out rail attached to the side of the drawer, and preferably an intermediate rail in between the fixed and pull-out rails. The intermediate rail is slidable over the fixed rail and the pull-out rail is slidable over the intermediate rail due to slidable roller housings disposed within the fixed and pull-out rails. Each of the fixed, intermediate and pull-out rails is also normally disposed with pairs of limit stoppers. The distance traveled by the slidable roller housings between each pair of limit stoppers on each rail element typically defines the travel distance of each rail. When the drawer having this typical guide rail system is either pushed in or pulled out, quite a loud noise is inevitably produced due to direct contact between the ends of the slidable roller housings and the limit stoppers.

In order to overcome this problem, an existing drawer sliding guide rail system with noise damping means is disclosed in Malaysian patent application no. PI 20033759. In addition to the above-described typical guide rail system construction, this prior system has a pair of damping means provided on the intermediate rail. This prior damping means consists of an elongate member of resilient material having a first pair of legs connected on one side by a web with a second pair of legs disposed to contact two U-shaped pieces, one of which is attached to the top surface of the fixed rail and the other is attached to the bottom surface of the pull-out rail. The damping means is retained on the intermediate rail by a tab of material punched out of the web of the rail and folded over to lie in the space between the first pair of legs and clamp the web on the resilient elongate member against the web of the rail. The pair of damping means together with the U-shaped pieces determine the distance of travel of the rail elements.

In this prior system, due to the contact of the damping means with the U-shaped pieces, when the drawer is either initially pushed in or pulled out, the limit stoppers of the rail elements do not engage with the ends of the roller housing thus dampening or eliminating noise. Subsequently, when the drawer is either pushed in further or pulled out further so as to be fully closed or fully extended, the second pair of legs of the resilient elongate member contactable with the U-shaped pieces is compressed resulting in the ends of the roller housings directly hitting the limit stoppers.

As the damping means are provided on the intermediate rail for contact with the U-shaped piece on both the fixed and pull-out rails, this prior system provides for an indirect dampening of the resulting noise when the ends of the roller housings hit the limit stoppers. This lack of direct dampening of the force of the roller housing hitting the stopper would inevitably result in unsatisfactory or negligible noise reduction.

Due to the shape and construction of this prior damping means, the contact surface or force-absorbing surface relative to the U-shaped piece consists of a surface of one of the second pair of legs of the resilient elongate member. In other words, the noise dampening of this prior system is dependent on proper contact between relatively small surfaces i.e. a surface of one of the second pair of legs with an upright surface of the U-shaped piece. In practice, this has proven to be an unreliable and ineffective noise dampening method especially, when great or excessive force is used to either push in or pull out the drawer. Also, it has been observed that the shape of this damping means does not facilitate frequent, sustained or vigorous usage over long periods of time as the second pair of legs that provide the noise dampening effect when in contact with the U-shaped piece frequently become bent beyond their resilient limit resulting in either improper contact due to the misshapen legs or at worse breaking of the second pair of legs.

Another prior guide rail system having damping means is disclosed in European patent application with publication no. EP 0 868 866 A2. This prior system has damping means comprising of resilient serpentine or meander shaped buffer protrusions that are integral with and protrude from the longitudinal ends of the slidable roller housing (carriages). The distance of travel of the rail elements is determined by the travel distance of the slidable roller housings between the pairs of limit stoppers. The serpentine-shaped protrusions of the roller housings are contactable with the limit stoppers of the rail elements and as such, function to dampen the noise by preventing direct contact of the roller housing ends with the stoppers. In this prior system, the damping means is integral with the roller housing and is made of plastic material.

Although, this prior system provides for direct dampening of the resulting noise when the ends of the roller housings hit the limit stoppers, the serpentine or meander shape of this damping protrusion dictates that the contact surface or force-absorbing surface consists of only the tip of the protrusion. In other words, the noise dampening of this prior system is dependent on contact with the limit stopper via a small surface i.e. the tip of the protrusion with a side surface of the stopper. Again, this is an ineffective noise dampening method especially, when great or excessive force is used to either push in or pull out the drawer. Also, as above, the shape of this damping protrusion does not facilitate frequent, sustained or vigorous usage over long periods of time as the serpentine or meander shape is likely to be bent beyond its resilient limit resulting in unsatisfactory dampening contact due to the misshapen damping protrusion.

Additionally, having the damping protrusion integral with the roller housing is not desirable or practical as in the event of the protrusion becoming ineffective due to it being misshapen for example, it would be necessary to replace the entire roller housing. Replacing this roller housing requires that the drawer be removed from the article of furniture and disengaged from this rail system and subsequently, for the rail system to be disassembled before replacement can be done.

Also, the design of this prior system necessitates that the roller housing having this integral damping protrusion be made of plastic material. Again, this is impractical as it would mean that the load bearing of this guide rail system is constrained enabling it to bear only a relatively light load. This is an undesirable constraint on the versatility of a guide rail system.

This invention thus aims to alleviate some or all of the problems of the prior art, and to provide a sliding guide rail system having damping means that is easily assembled and manufactured, practical, versatile and allows for vigorous and sustained usage.

SUMMARY OF THE INVENTION

In accordance with the invention, a sliding guide rail system for slidably opening and closing a drawer within an article of furniture is provided. The system comprises a mounting bracket for fixing the system to the article of furniture, a fixed guide mounted on the mounting bracket, an intermediate rail and a pull-out guide. The fixed and pull-out guides each have a slidably movable housing, a first slidable housing enabling the intermediate rail to be slidable on the fixed guide and a second slidable housing enabling the pull-out guide to be in turn slidable on the intermediate rail. Each of the fixed guide, intermediate rail and pull-out guide have stops disposed thereon for limiting the sliding movement of the first and second slidable housings. A resiliently deformable damping member is located in a respective chamber provided at each longitudinal end of the first and second slidable housings. The damping member has a buffer portion that projects out of and beyond its chamber for engaging with a stop at the travel limit of the slidable housing, the chamber being oversized relative to the portion of the damping member disposed within the chamber whereby the chamber accommodates expansion of the damping member when it is deformed by impact with the stop.

In a preferred embodiment, the damping member is removable from the chamber. The chamber may be open at one face to enable the damping member to be inserted and removed. In an embodiment, the chamber comprises a chamber space and a slot with the slot disposed at the end of the slidable housing. The damping member preferably then comprises a body portion and a relatively narrower neck portion, the body portion being located within the chamber space and the narrower neck portion being located in the slot of the chamber so as to retain the damping member. Also, the damping member neck portion suitably includes the buffer portion as the portion of the neck that extends outwardly beyond the slot. The chamber space may be oversized relative to the damping member body portion to allow for the expansion of the body portion when the damping member is deformed on impact with the stop. The damping member body portion preferably has a concave base to facilitate the expansion of the body portion.

In another embodiment of the invention, the chamber slot is oversized relative to the damping member neck portion to allow for the expansion of the neck portion when the damping member is deformed on impact with the stop. Of course, both the chamber space and the slot may also be oversized.

The objective of the sliding guide rail system having damping means of this invention is to provide direct contact between the damping member and the stop in order to directly and effectively reduce the noise which occurs when the sliding housing ends impact the stops of the guides when the drawer is pushed in or pulled out of the article of the furniture. Also, as is apparent from the preceding paragraphs, the contact surface of the damping member i.e. the buffer portion protruding from the sliding housing end or chamber slot can be relatively larger than that of the above-described prior art, thus, providing for efficient and effective noise dampening even if excessive force is used when pushing or pulling the drawer.

Additionally, the shape of the damping member together with configuration of the chamber of the sliding housing ends allows for the damping member to be deformed by either its body portion expanding within an oversized chamber space or its neck portion which includes the buffer portion, expanding within an oversized chamber slot. In other words, the noise dampening in this system is achieved via the deforming of the damping member within the chamber of the sliding housing. This form and function of the damping member would allow for reliable and long-term effective noise dampening in the face of sustained, frequent and vigorous usage without either failing physically or being deformed past its resilient limit.

Furthermore, the removability of the damping member with the chamber of the sliding housing also allows for the possibility of replacing only the damping member if the damping member fails, without the need to replace the sliding housing as well. Also, this feature allows for the possibility of the damping member and the sliding housing being made of different material, for example, the sliding housing may be made of metal in order to allow this sliding guide rail system to withstand a heavier load with the damping member made of a resilient material such as plastic or rubber. Greater versatility and flexibility of usage is therefore accorded to this system allowing it to be usable in a wide variety of applications.

In a further embodiment, a pair of the damping members is disposed at each end of the slidable housing.

According to yet another embodiment, the stop comprises a tab that is integral to the guide or rail. This could be, for example, a metal lug that is cut and bent out of the plane of the surface of a metal guide or rail or a moulded protrusion in the case of a plastic guide or rail.

BRIEF DESCRIPTION OF THE DRAWINGS

The invention is illustrated, although not limited, by the following description of embodiments made with reference to the accompanying drawings in which:

FIG. 8 is a side view of the embodiment of FIG. 6 prior to damping members being deformed when the drawer is pushed in.

FIG. 9 is a side view of the embodiment of FIG. 6 after the damping members are deformed when the drawer is fully pushed in.

DETAILED DESCRIPTION OF THE EMBODIMENTS

Figure 1:
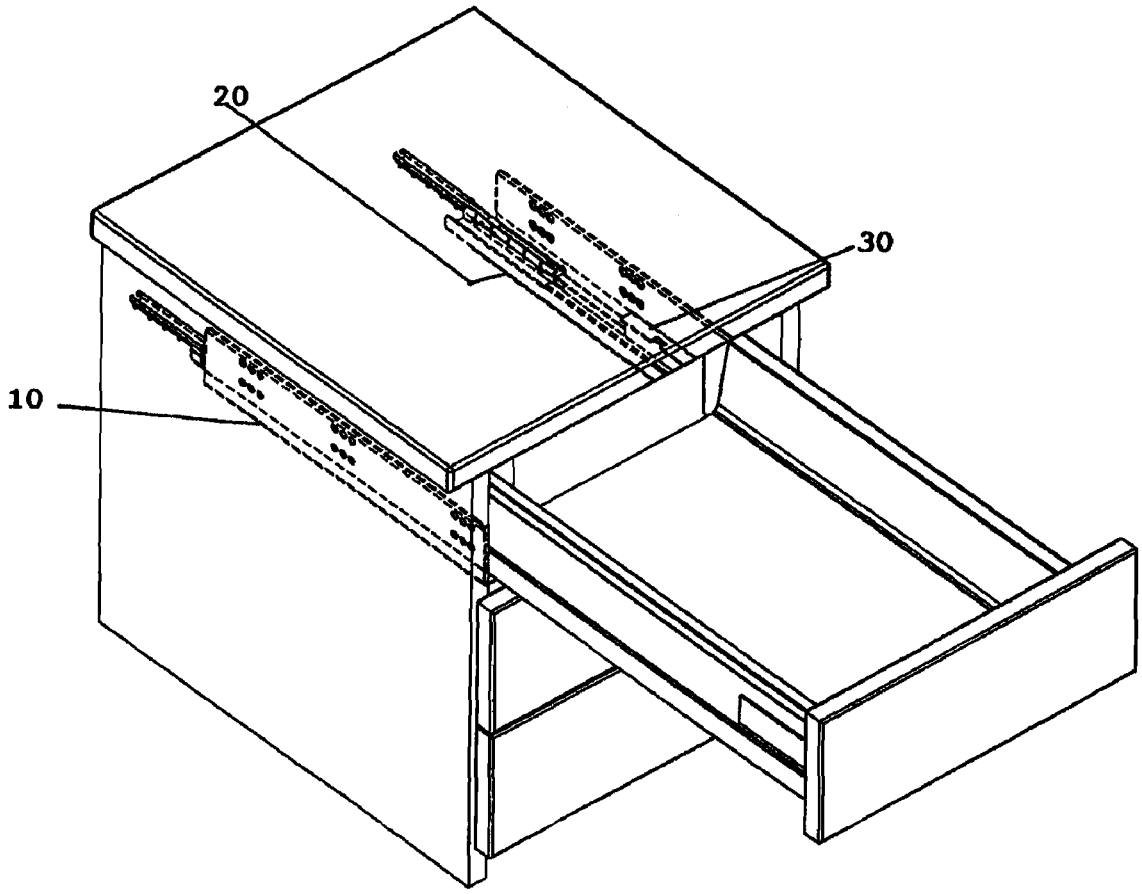
FIG. 1 illustrates a drawer having a sliding guide-rail mechanism of the present invention within an article of furniture.
Figure 2:
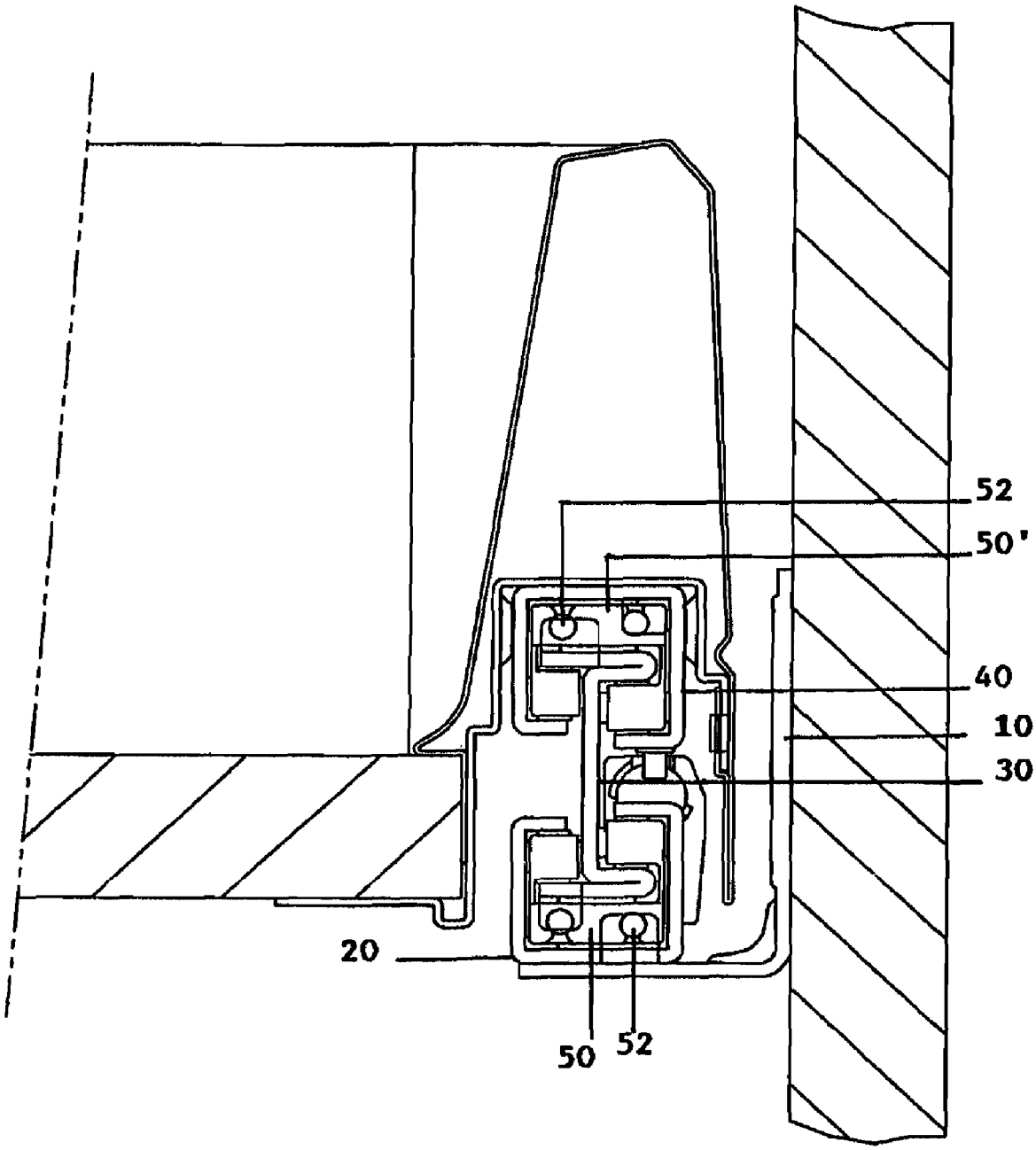
FIG. 2 shows a sectional view of a preferred embodiment of the invention.

FIG. 1 shows a sliding guide rail system having damping means of the present invention assembled and attached to each side of a drawer within an article of furniture. The sliding guide rail system comprises of a mounting bracket 10 for fixing the system to the article of furniture, a fixed guide 20 mounted on the mounting bracket 10, an intermediate rail 30 and a pull-out guide 40 secured to the drawer side. The fixed 20 and pull-out guides 40 each have a slidable housing with a first slidable housing 50 enabling the intermediate rail 30 to be slidable on the fixed guide 20 and a second slidable housing 50' enabling the pull-out guide 40 to be in turn slidable on the intermediate rail 30, as shown in FIG. 2. Both these sliding housings 50, 50' have a pair of laterally spaced-apart chambers 51 at each longitudinal end. In this embodiment, each chamber has a damping member 52, 52' located therein.

Figure 3:
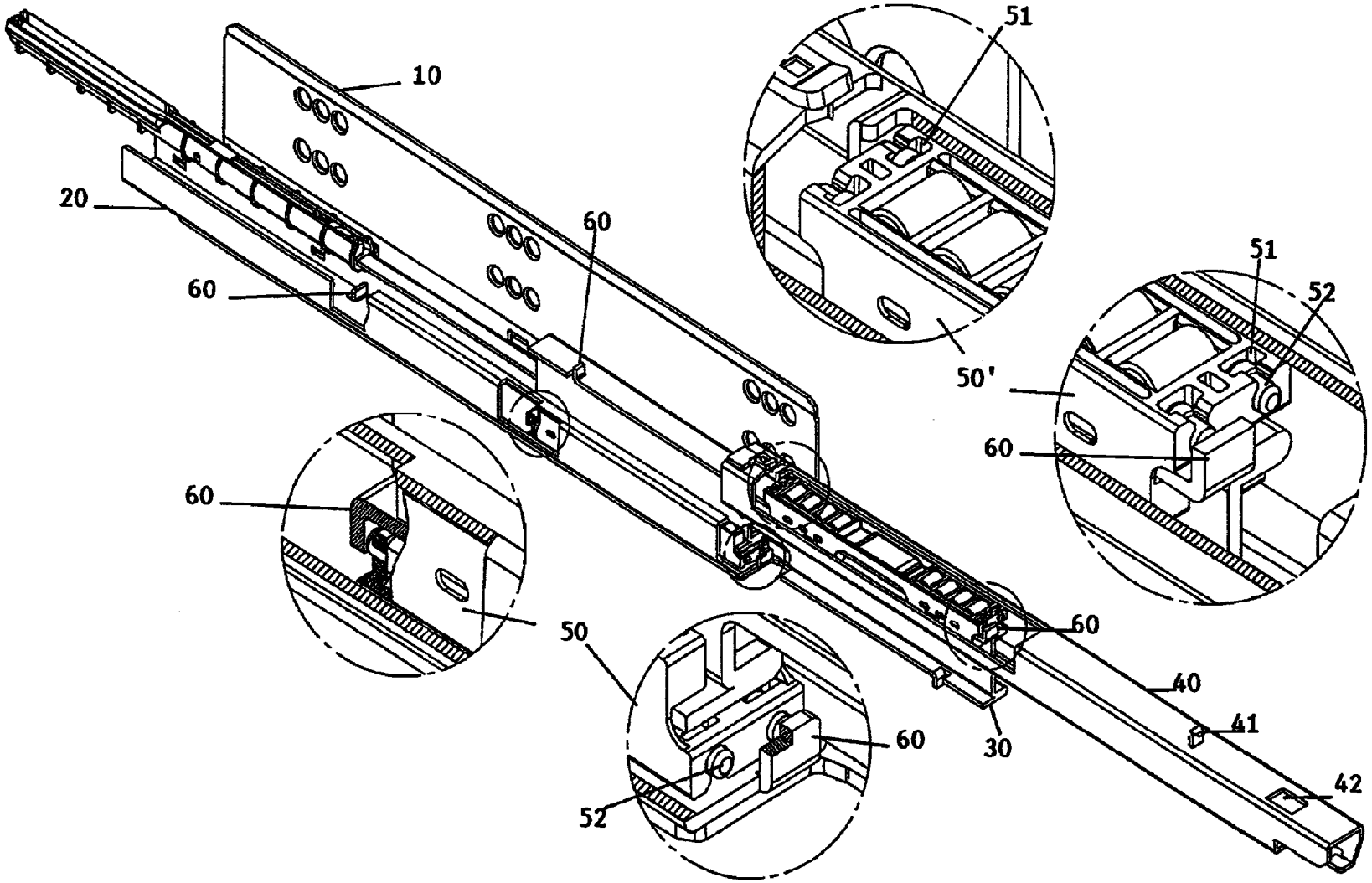
FIG. 3 shows a perspective view of the preferred embodiment of the invention.

FIG. 3 shows the mounting bracket 10 is formed from a sheet metal into a substantially L-section comprising of a vertical flange and a horizontal flange. The vertical flange has a multitude of holes for fixing to the side of an article of furniture such as a cabinet or chassis into which a drawer or equipment is to be installed in. Stepped edges are also formed on this vertical flange in order to increase its rigidity. Similarly, notches are formed at the bent edge of the L-section for increasing the rigidity and load capacity of this mounting bracket. The fixed guide 20 of the system is attached onto the horizontal flange of the mounting bracket 10.

This fixed guide 20 is formed from sheet metal into an open C-section. Stops 60 consisting of punched-out tabs that are bend inwardly are formed at either or opposite sides towards the longitudinal ends of the guide 20. Slidably fitted inside this fixed guide 20 is a first sliding housing 50 having rollers 53, 54 wherein this first sliding housing runs smoothly on its rollers 53, 54 inside the guide 20 between the stops 60.

The intermediate rail 30 is formed from sheet metal into a substantially I-section or alternatively a composite of two Ts with upper and lower horizontal flanges with a vertical web. The bent edges of the upper and lower flanges are either on the same side as each other or at opposite sides. Two pairs of stops 60 are formed spaced apart on the upper and lower surfaces of the lower and upper flanges respectively that may again consist of inwardly bent punched-out tabs. This intermediate rail 30 may be installed with no distinction as to which end is forward. Also, this rail may be provided with the punched-out tabs of stops 60 not yet bent so that these tabs may be bent in the required direction during assembly or installation. This would allow for flexibility during assembly of this system and also advantageously reduces the number of parts required for stocking.

Pull-out guide 40 is formed from a sheet metal into an open C-section. On either side of this guide are two stops 60 disposed such that each stop is located towards a longitudinal end of the guide. These stops 60 consist of punched-out tabs that bend inwardly. An L-shaped extension 41 is cut or formed on the upper surface of this pull-out guide 40. This extension 41 engages with an attachment (not shown) on the drawer side for fixing this guide 40 to the drawer. An aperture 42 is also punched on the upper surface of this guide at the front end (relative to drawer orientation) to allow for engagement with a catch (not shown) mounted at the front of the drawer side. This allows for the drawer to be easily and removably attached with the pull-out guide 40. Slidably fitted inside this guide 40 is a second sliding housing 50' having rollers 53, 54 wherein this second sliding housing 50' runs smoothly on its rollers 53, 54 inside the guide 40 between the stops 60.

Figure 4:
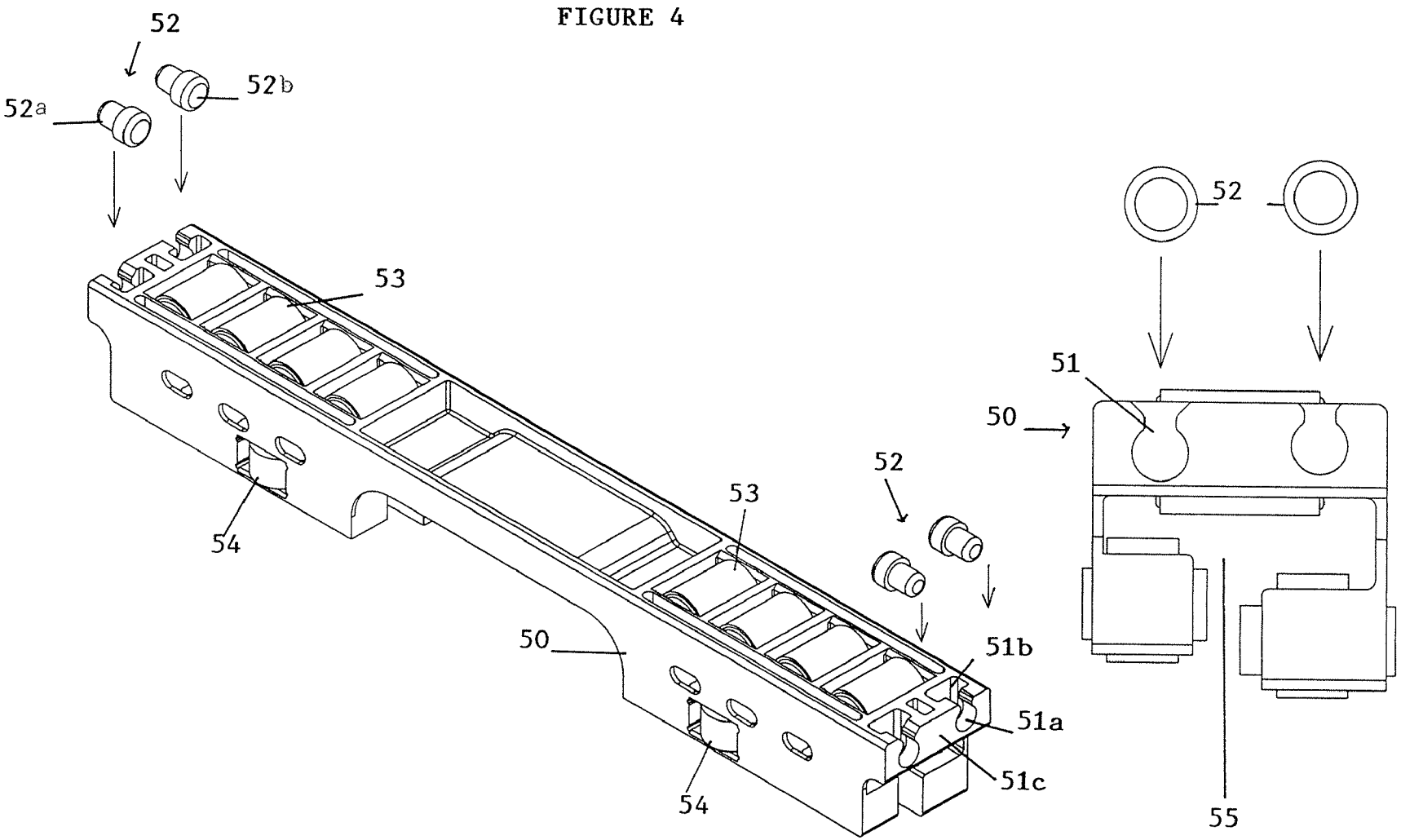
FIG. 4 is a perspective view of a sliding housing of the preferred embodiment of the invention with damping members removed therefrom.
Figure 5:
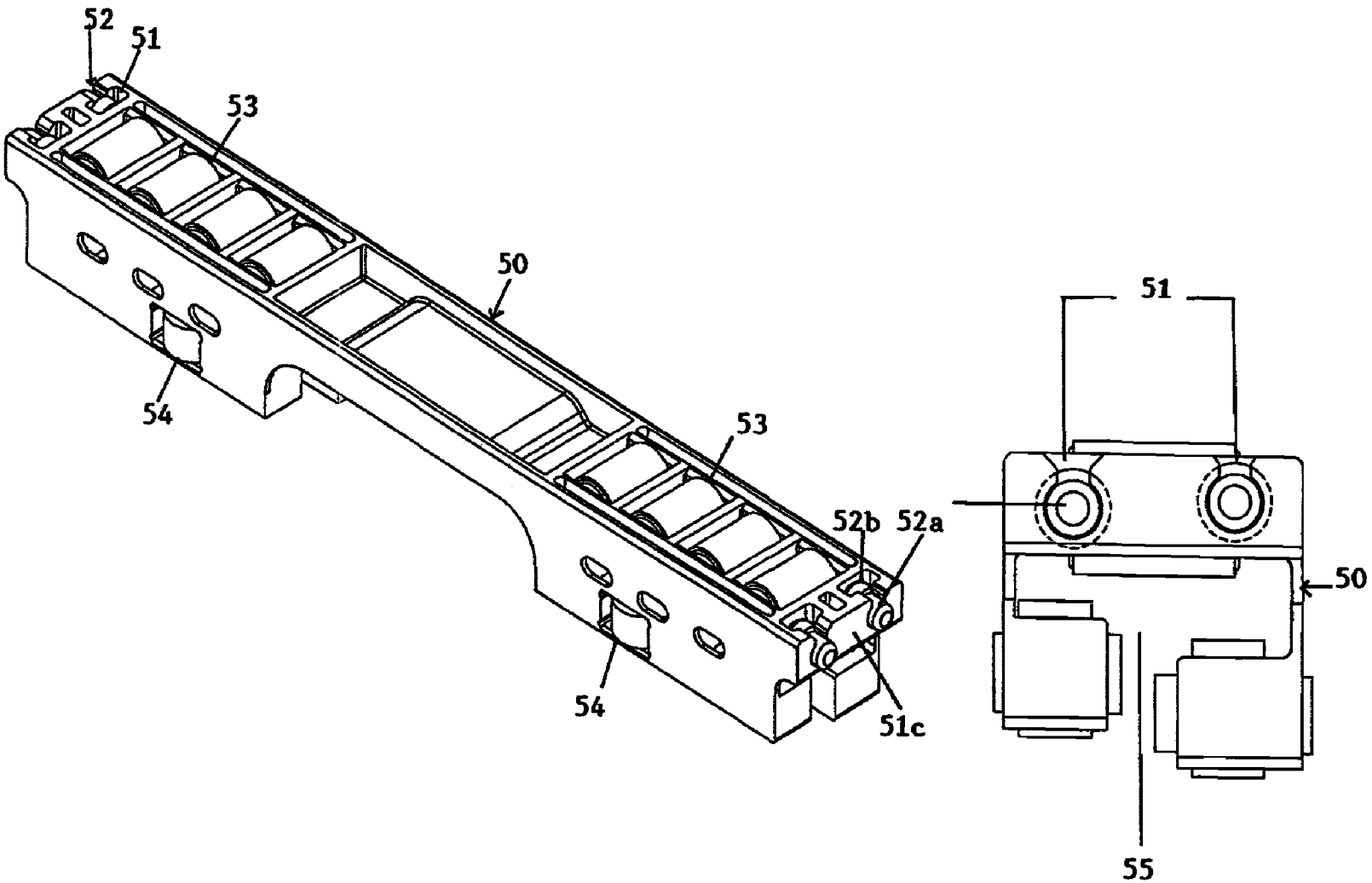
FIG. 5 is a perspective view of a sliding housing of the preferred embodiment of the invention with damping members mounted within.
Figure 6:
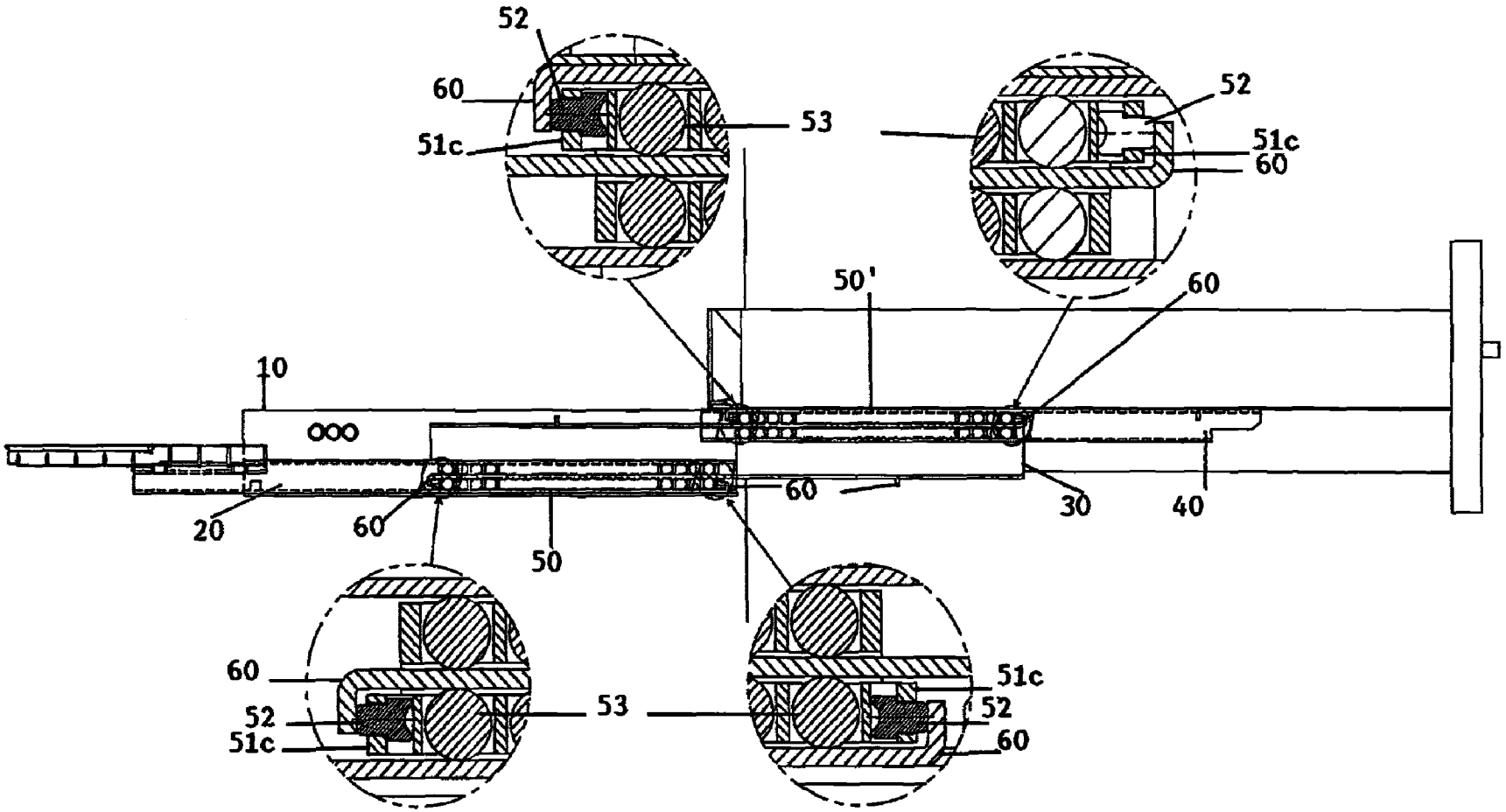
FIG. 6 shows a side view of the preferred embodiment of the invention prior to damping members being deformed when drawer is pulled out.
Figure 7:
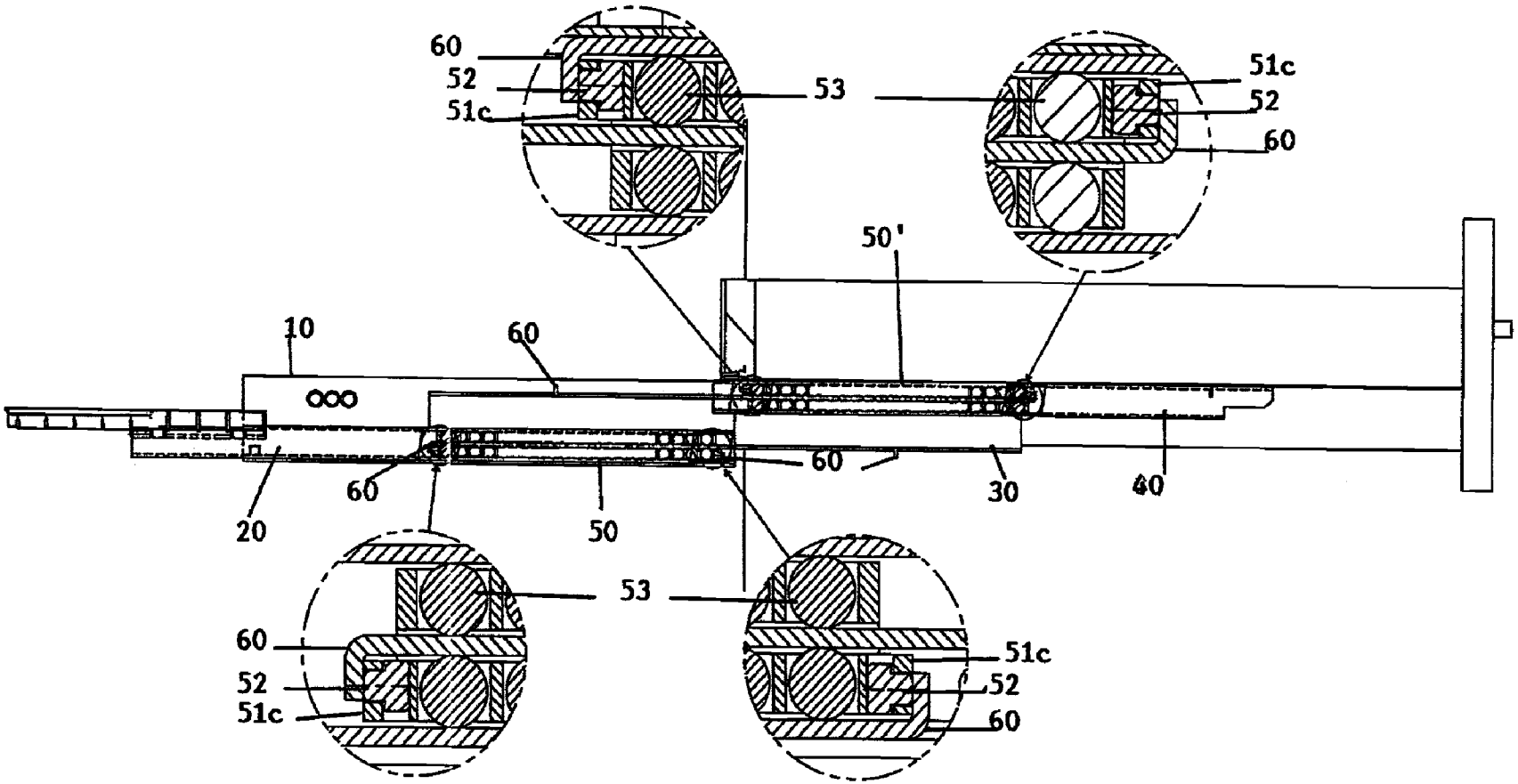
FIG. 7 shows a side view of the embodiment of FIG. 6 after the damping members are deformed when the drawer is pulled out.
Figure 8:
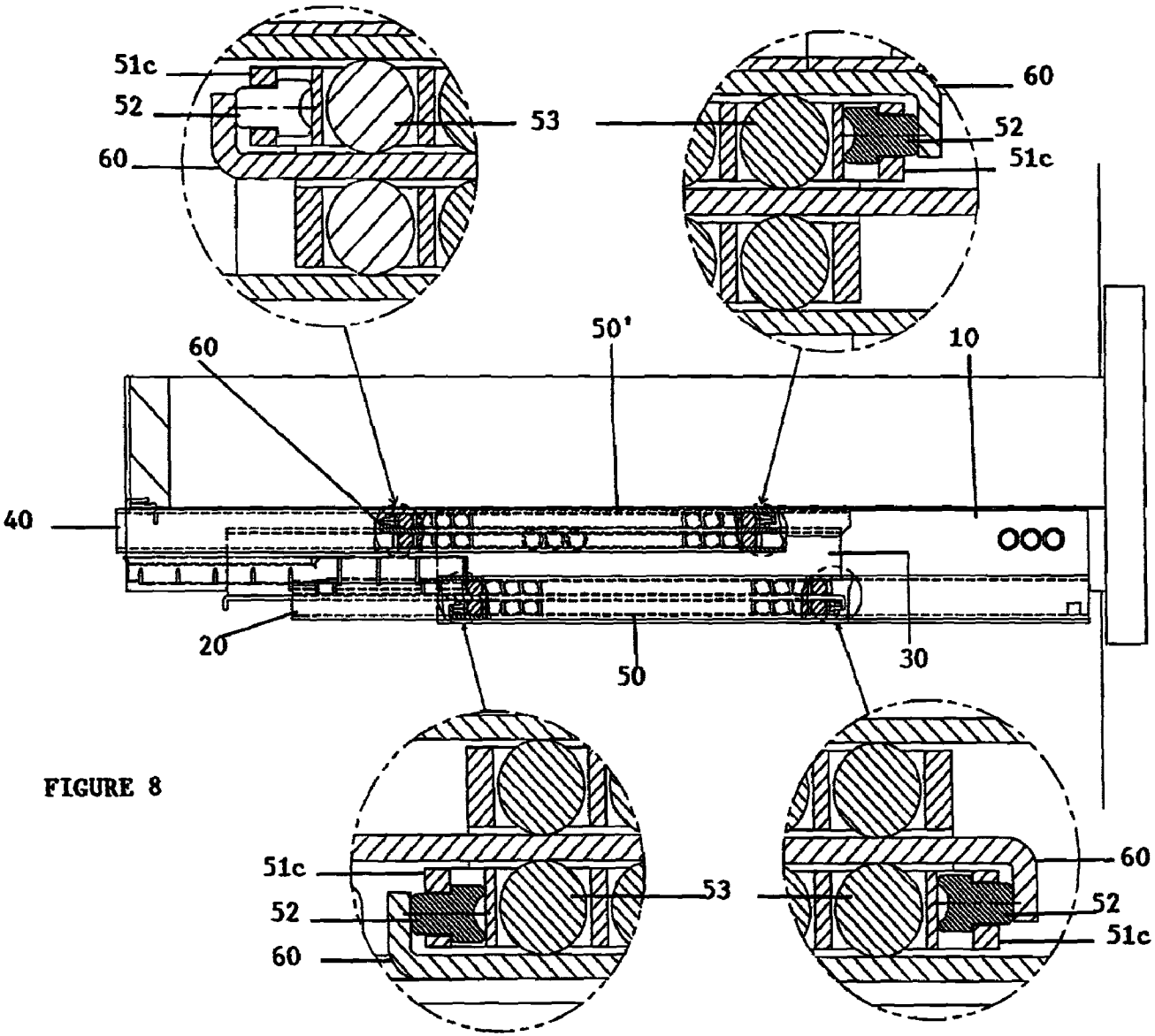
Figure 9:
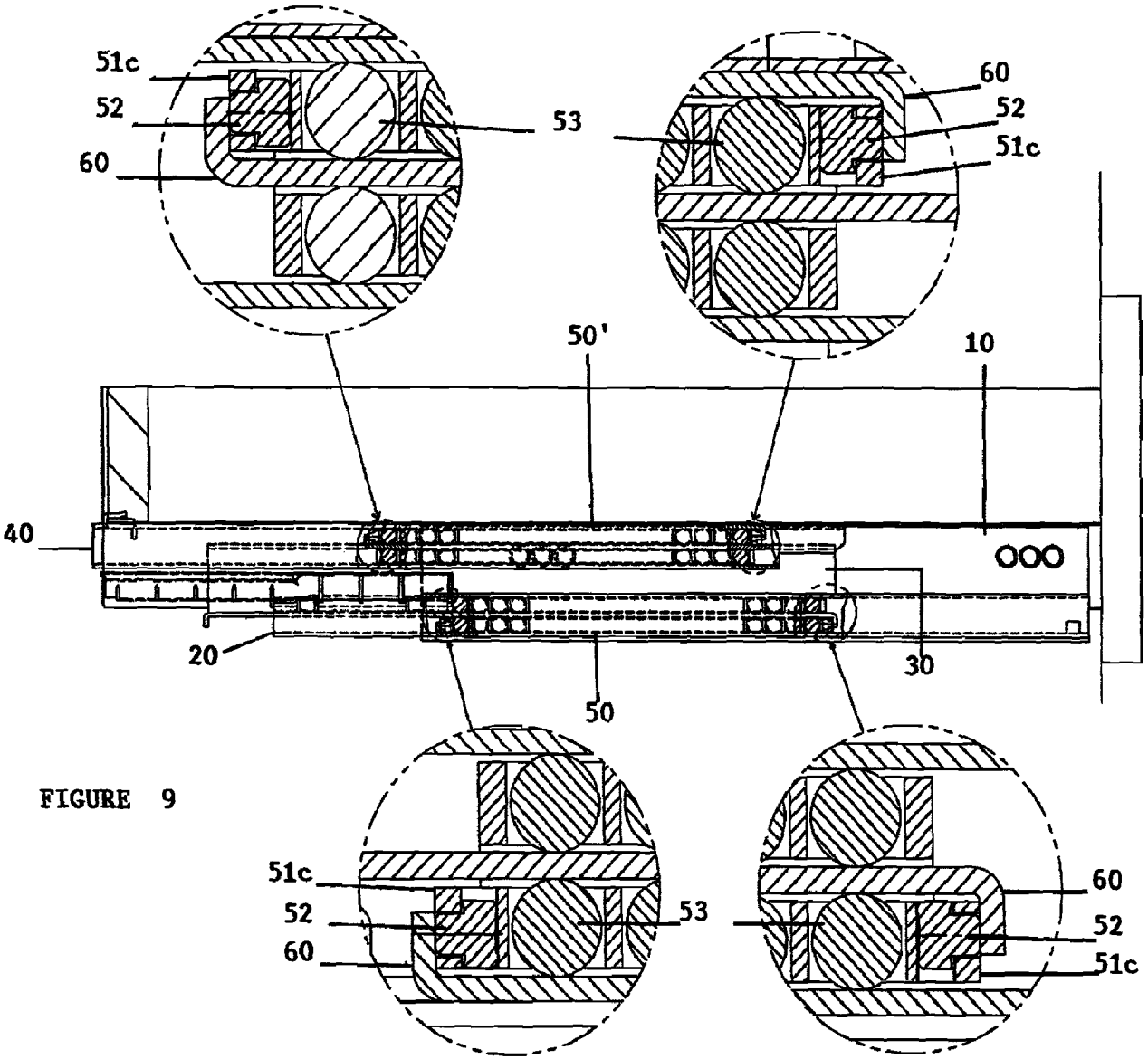
Figure 10:
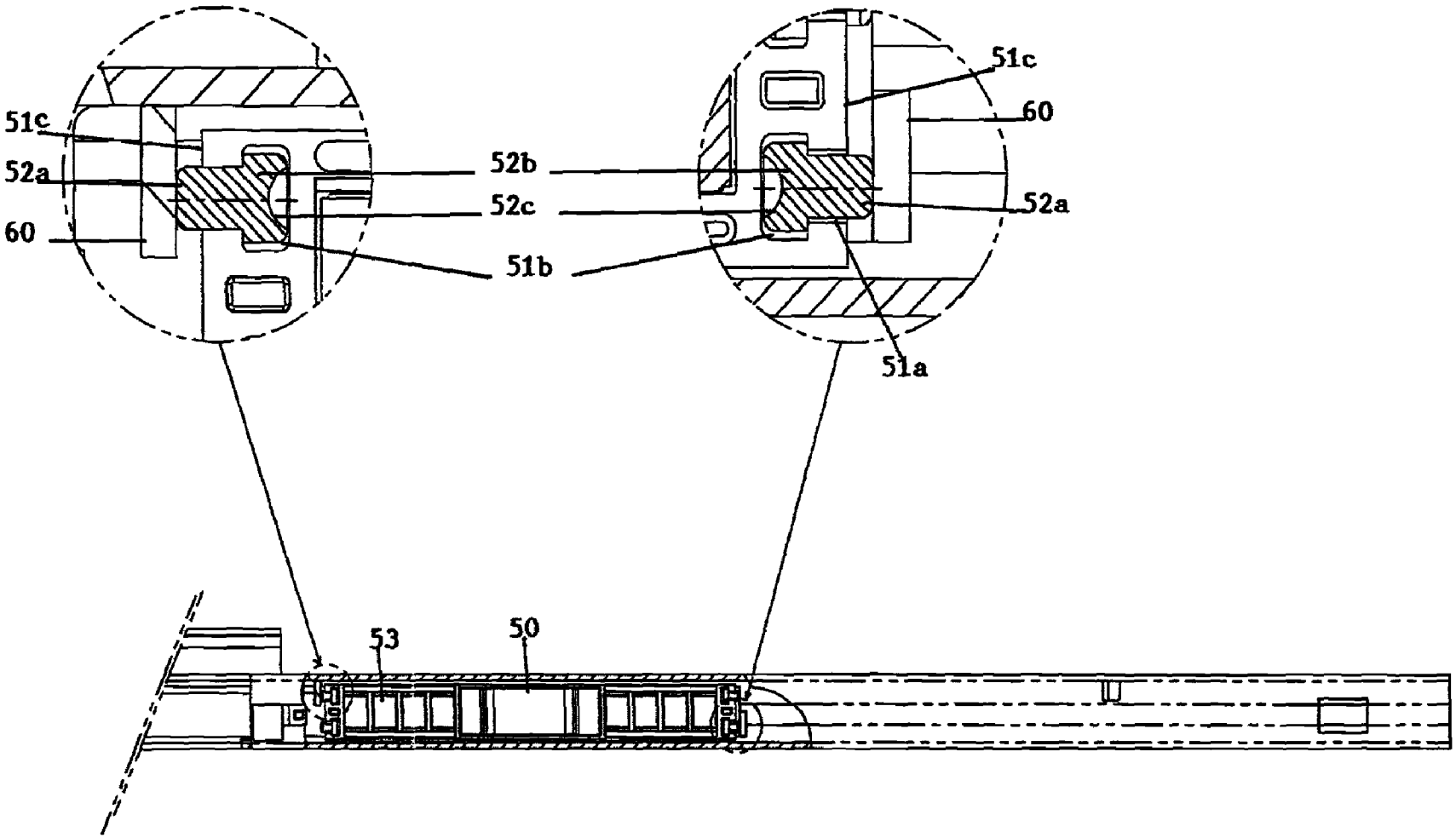
FIG. 10 depicts a top view of FIG. 6.
Figure 11:
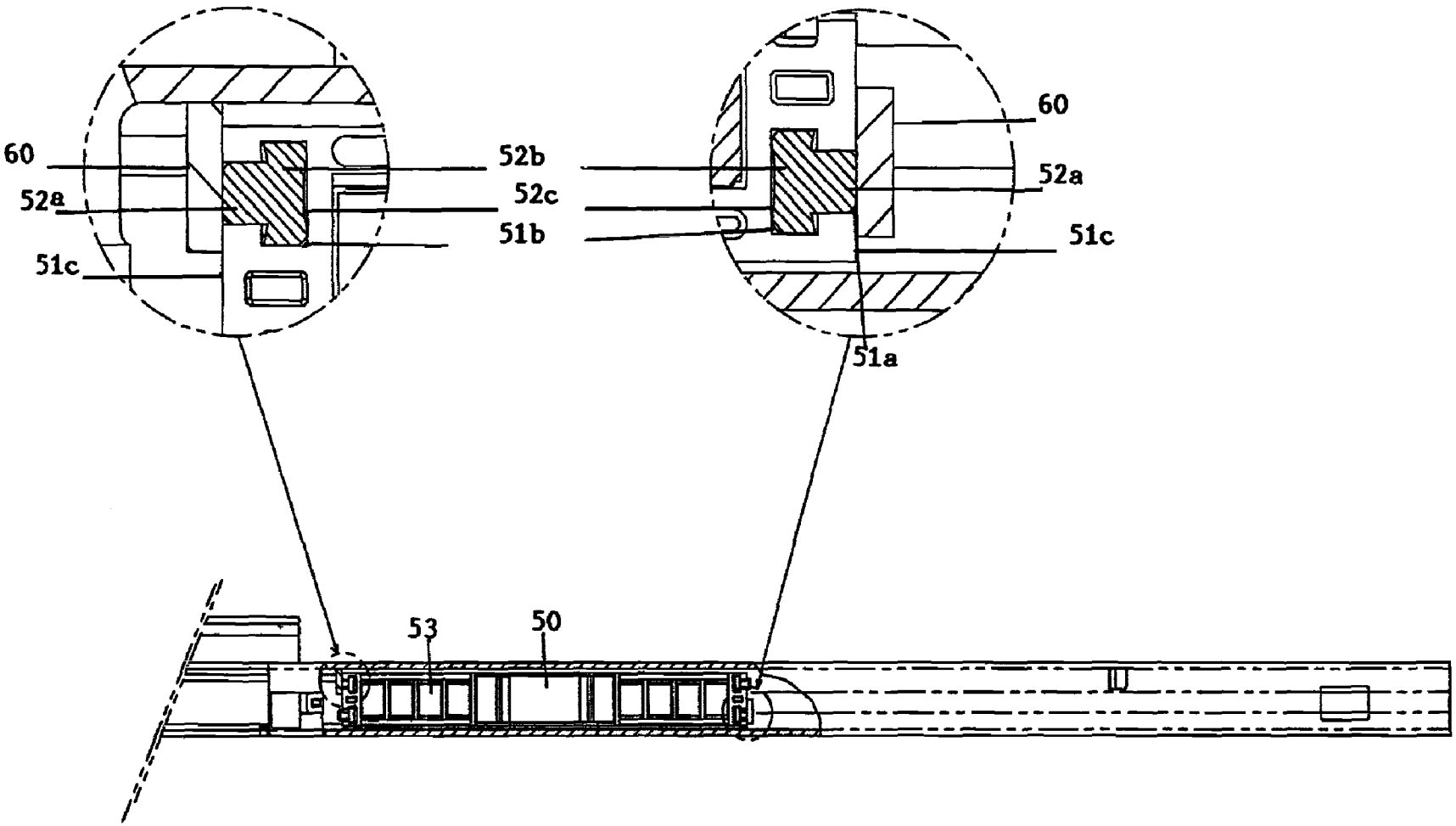
FIG. 11 shows the top view of FIG. 7.
Figure 12A:
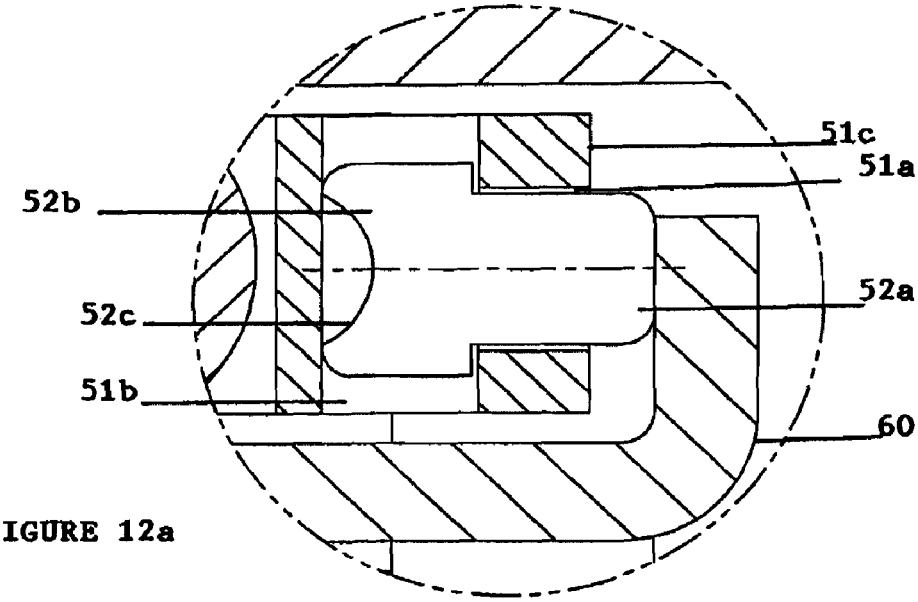
FIG. 12*a* is an enlarged view of the damping member shown in FIGS. 6 and 8.
Figure 12B:
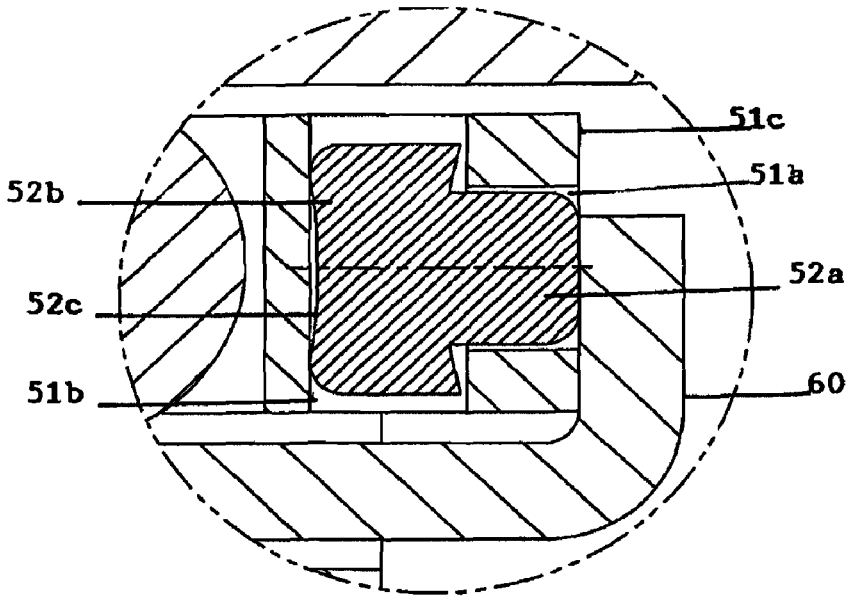
FIG. 12*b* is an enlarged view of the damping member shown in FIGS. 7 and 9.

The first and second sliding housings 50, 50' are of a similar construction and comprise a long member having a substantially rectangular cross-section with a hollow central recess 55 in the form of an open T, as seen in FIGS. 4 and 5. Rollers 53 are provided at the upper part and both sides of the T. The side rollers 54 are vertically displaced by a distance substantially equal to the thickness of the vertical web of the intermediate rail 30. The number, type (whether upper 53 or side rollers 54) and configuration of rollers depend on the load capacity for which the sliding housings 50, 50' are designed for. Further side rollers (not shown) that provide lateral guidance for the drawer/equipment may also be provided, wherein when these rollers are spaced as far apart as possible, greater lateral stability is provided. The open T-shaped recess 55 of the first sliding housing 50 enables the intermediate rail 30 to be slidable on the fixed guide 20 with the lower flange of the rail slidably fitted therein. Similarly, the open T-shaped recess 55 of the second sliding housing 50' enables the pull-out guide 40 to be slidable on the intermediate rail 30 with the upper flange of the rail slidably fitted therein. Adequate clearances are provided between the upper rollers 53 and the respective contact surfaces of both the upper and lower flanges of the intermediate railing 30 for ease of alignment and/or assembly. Similarly, adequate clearances are provided between side rollers 54 and the contact surfaces of the vertical web of the intermediate rail 30.

In the upper portion at each longitudinal end of both the first 50 and second sliding housings 50', a pair of chambers 51 that are laterally spaced apart is provided. These chambers 51 are substantially T-shaped and are preferably open at one face, here the upper or lower face of the roller housing, in order to enable a deformable damping member 52 to be removably located inside. The chamber 51 preferably comprises a chamber space 51*b*, and a slot 51*a* that opens at the face 51*c* at the end of the sliding housing 50, 50'.

In the preferred embodiment seen in FIGS. 3 to 12*a* and 12*b*, the damping member 52 is preferably cylindrical and substantially T-shaped with a buffer portion that projects out of and beyond its chamber 51 for engaging with a stop 60 at the travel limit of the respective sliding housing 50, 50'. This T-shaped damping member 52 comprises a body portion 52*b* having a concave or curved-in base 52*c* and a relatively narrower neck portion 52*a* that includes the buffer or head portion and is made of resilient material such as plastic or rubber. The body portion 52*b* of the damping member 52 is located inside the chamber space 51*b* whereas the narrower neck portion 52*a* is located inside the chamber slot 51*a* so as to retain the damping member 52. The damping member 52 is simply pushed into place in the chamber 51 through the opening at the top of the housing 50, 50'. The chamber slot 51*a* has a narrower entrance portion that is open at the top opening of the housing 50, 50' and leads to a circular aperture portion that receives neck portion 52*a* of the damping member and the damping member 52 is thus retained inside the chamber 51, once its neck has been pushed through the slot entrance. The chamber space 51*b* is oversized relative to the damping member body portion 52*b* to allow for the expansion of the body portion 52*b* when the damping member 52 is deformed on impact with the stop 60.

In use, when the drawer is being pulled out or pushed into the article of furniture, both the first 50 and second sliding housings 50' come into contact with the stops 60 of the fixed guide 20, intermediate rail 30 and pull-out guide 40, at their longitudinal ends. These fixed guide, intermediate rail and pull-out guide stops 60 limit the sliding movement of the first 50 and second sliding housings 50' and therefore, the travel distance of the intermediate rail 30 and pull-out guide 40. The protruding buffer-portions of the damping members 52 at each end of the sliding housings 50, 50' will be contacted with the stops 60. As the drawer is either pulled out to be fully extended from the article of furniture or pushed in to be fully inserted into the article of furniture, the narrow neck portion 52*a* of the damping member 52 is compacted as its protruding buffer portion is pressed against the stop 60. Consequently, the body portion 52*b* of the damping member 52 is caused to expand within the chamber space 51*b* with its concave base 52*c* flattening out to facilitate such expansion, and the stop 60 will contact the end face 51*c* of the sliding housing 50, 50', thus preventing over deforming of the damping members 52. The damping members 52, thus deformed, will absorb a sufficient part of the kinetic energy resulting from the lateral pulling or pushing force so that significantly less noise is produced as a result and achieving a "cushioning" effect. When no lateral pulling or pushing force is applied on the guide rail assemblies, the resilient damping members 52 resume their original uncompressed form.

Figure 13A:
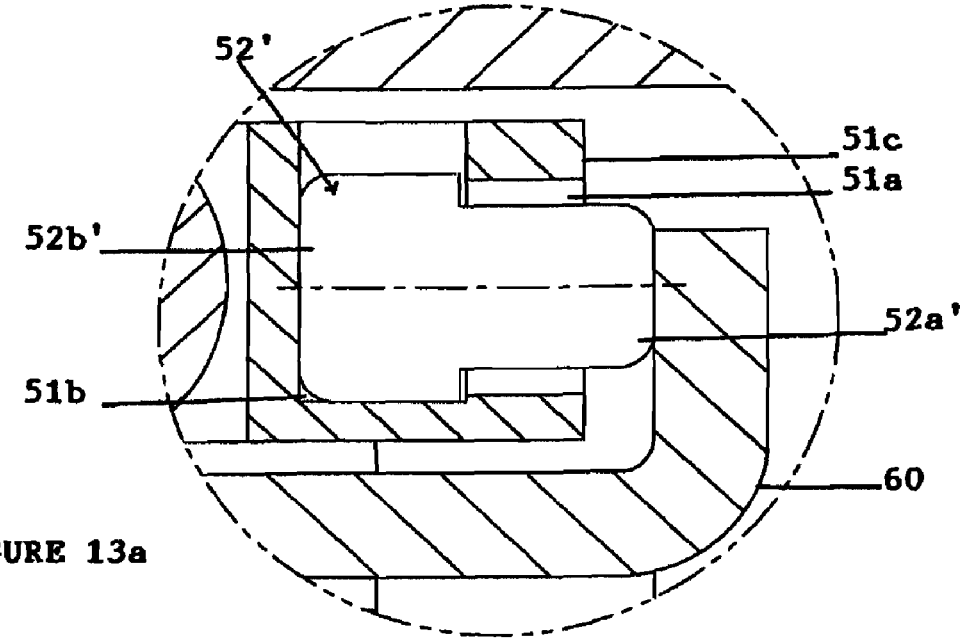
FIG. 13*a* is an enlarged view of the damping member of another embodiment prior to the damping member being deformed.
Figure 13B:
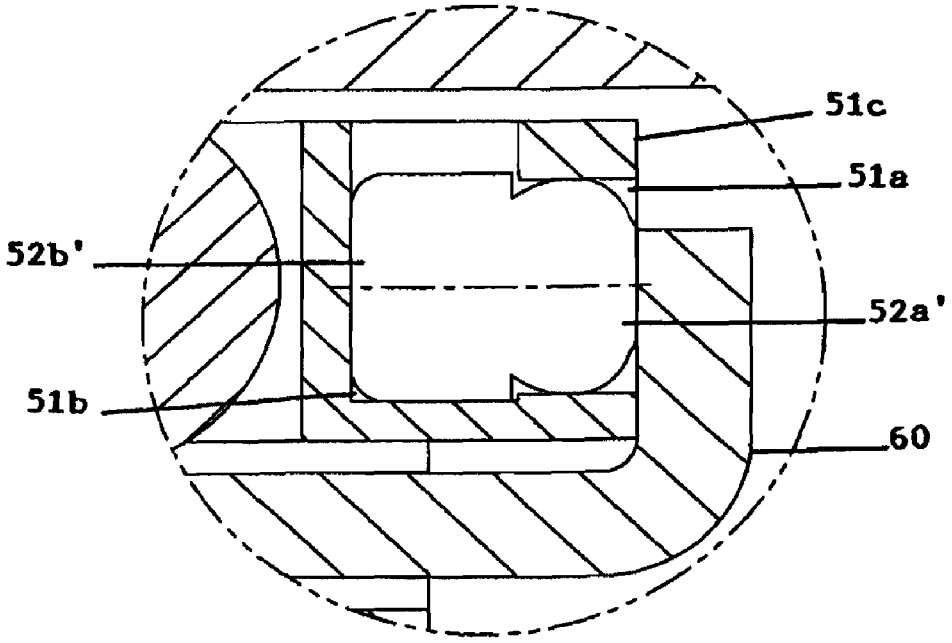
FIG. 13*b* is an enlarged view of the damping member of FIG. 13*a* after the damping member is deformed.

In another embodiment shown in FIGS. 13*a* and 13*b*, the chamber slot 51*a*, especially the circular aperture portion, is oversized relative to the damping member neck portion 52*a*' that includes the protruding buffer portion such that there are gaps on either side of the neck portion 52*a*'. This configuration allows for the expansion of the neck portion 52*a*' when the damping member 52' is deformed on impact with the stop 60. The body portion 52*b*' of the damping member 52' of this embodiment has a substantially flat base.

In use, as in the above-described preferred embodiment, when the drawer is being pulled out or pushed into the article of furniture, both the first 50 and second sliding housings 50' come into contact with the stops 60 of the fixed guide 20, intermediate rail 30 and pull-out guide 40. As the drawer is either pulled out to be fully extended from the article of furniture or pushed in to be fully inserted into the article of furniture, the neck portion 52*a*' is compacted as its protruding buffer portion is pressed against the stop 60. Due to the oversized chamber slot 51*a*, the neck portion 52*a*' of the damping member 52' is caused to expand or bulge out within the circular aperture of slot 51*a*. As above, the damping members 52', thus deformed, will absorb a sufficient part of the kinetic energy resulting from the lateral pulling or pushing force and achieving a "cushioning" effect. Again, when no lateral pulling or pushing force is applied on the guide rail assemblies, the resilient damping members 52' resume their original uncompressed form.

In the event replacing of the damping member 52, 52' becomes necessary, it may be removed from the chamber 51 of the sliding housing 50, 50' by simply pulling the member upward through the opening at the top of the housing by grabbing the protruding head portion and easing the neck 52*a* out through the entrance of the slot. This is possible due to the resilient nature of the damping member 52, 52'.

As will be readily apparent to those skilled in the art, the present invention may easily be produced in other specific forms without departing from its scope or essential characteristics. The present embodiments are, therefore, to be considered as merely illustrative and not restrictive, the scope of the invention being indicated by the claims rather than the foregoing description, and all changes which come within therefore intended to be embraced therein.

The invention claimed is:

1. A sliding guide rail system for slidably opening and closing a drawer, the system comprising a mounting bracket (10), a fixed guide (20) mounted on the mounting bracket, an intermediate rail (30) and a pull-out guide (40), said fixed and pull-out guides each having a slidably movable housing, a first slidable housing (50) enabling the intermediate rail to be slidable on said fixed guide (20) and a second slidable housing (50') enabling said pull-out guide to be in turn slidable on said intermediate rail, each of said fixed guide, intermediate rail and pull-out guide having stops (60) disposed thereon that limit the sliding movement of said first and second slidable housings, wherein a resiliently deformable damping member (52, 52') is located in a respective chamber (51) provided at each longitudinal end of said first and second slidable housings, the chamber comprising a chamber space (51*b*) and a slot (51*a*) with said slot disposed at the end of said slidable housing (50, 50'), said damping member comprises a generally cylindrical body located within said chamber in said slot (51*a*) of said chamber (51) that retains the damping member, the damping member having a buffer portion that projects out of and beyond its chamber for engaging with a said stop at the travel limit of the slidable housing, said chamber configured to accommodate expansion of said damping member (52, 52') when the damping member is deformed by impact with said stops.

2. A sliding guide rail system as claimed in claim 1, wherein said damping member (52, 52') is removable from said chamber (51).

3. A sliding guide rail system as claimed in claim 2, wherein the chamber (51) is open at one face to enable the damping member (52, 52') to be inserted and removed.

4. A sliding guide rail system as claimed in claim 1, wherein said chamber slot (51*a*) is oversized relative to said damping member cylindrical body (52*a*') to allow for the expansion of the cylindrical body when said damping member (52') is deformed on impact with said stop (60).

5. A sliding guide rail system as claimed in claim 4, wherein said chamber space (51*b*) is oversized relative to said damping member cylindrical body (52*b*) to allow for the expansion of said cylindrical body when said damping member (52) is deformed on impact with said stop (60).

6. A sliding guide rail system as claimed in claim 5, wherein said damping member (52, 52') comprises a body portion (52*b*, 52*b*') and a relatively narrower neck portion (52*a*, 52*a*'), said body portion being located within said chamber space (51*b*) and said narrower neck portion being located in said slot (51*a*) of said chamber (51) so as to retain the damping member.

7. A sliding guide rail system as claimed in claim 4, wherein said damping member cylindrical body (52*b*) has a concave base (52*c*) to facilitate the expansion of said cylindrical body.

8. A sliding guide rail system as claimed in claim 6, wherein said damping member (52, 52') comprises a body portion (52*b*, 52*b*') and a relatively narrower neck portion (52*a*, 52*a*'), said body portion being located within said chamber space (51*b*) and said narrower neck portion being located in said slot (51*a*) of said chamber (51) so as to retain the damping member.

9. A sliding guide rail system as claimed in claim 1, wherein said chamber space (51*b*) is oversized relative to said damping member cylindrical body (52*b*) to receive said body portion when said damping member (52) is deformed on impact with said stop (60).

10. A sliding guide rail system as claimed in claim 1, wherein a pair of said damping members (52, 52') is disposed at each end of said slidable housing (50, 50').

11. A sliding guide rail system as claimed in claim 10, wherein said damping member cylindrical body (52*b*) has a concave base (52*c*) to facilitate the expansion of said cylindrical body.

12. A sliding guide rail system as claimed in claim 1, wherein said stop (60) comprises a tab that is integral to said guide or rail (20, 30, 40).

* * * * *